US006231152B1

(12) United States Patent
Sato et al.

(10) Patent No.: US 6,231,152 B1
(45) **Date of Patent: *May 15, 2001**

(54) INK JET RECORDING METHOD EMPLOYING CONTROL OF INK TEMPERATURE

(75) Inventors: Koichi Sato, Kanagawa-ken; Hiroyuki Ishinaga, Tokyo, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/376,667

(22) Filed: Jan. 23, 1995

Related U.S. Application Data

(63) Continuation of application No. 07/934,900, filed on Aug. 26, 1992, now abandoned, which is a continuation of application No. 07/577,735, filed on Sep. 5, 1990, now abandoned.

(30) Foreign Application Priority Data

Sep. 5, 1989 (JP) ..... 1-228202

(51) Int. Cl.[7] ..... B41J 29/38; B41J 2/01
(52) U.S. Cl. ..... 347/16; 347/17; 347/105
(58) Field of Search ..... 347/17, 14, 20, 347/105, 16

(56) References Cited

U.S. PATENT DOCUMENTS

| | | | | |
|---|---|---|---|---|
| 4,296,421 | | 10/1981 | Hara et al. | 347/48 |
| 4,328,261 | | 5/1982 | Heinecke et al. | 427/91 |
| 4,376,945 | | 3/1983 | Hara et al. | 347/67 |
| 4,642,654 | * | 2/1987 | Toganoh | 347/105 |
| 4,707,705 | | 11/1987 | Hara et al. | 347/47 |
| 4,719,472 | * | 1/1988 | Arakawa | 347/17 X |
| 4,723,129 | | 2/1988 | Endo et al. | 347/56 |
| 4,795,999 | * | 1/1989 | Takahashi . | |
| 4,899,180 | | 2/1990 | Elhatem | 347/17 X |
| 4,914,562 | | 4/1990 | Abe et al. | 347/63 |
| 5,006,867 | * | 4/1991 | Koizumi | 347/17 |
| 5,107,276 | * | 4/1992 | Kneezel | 347/17 X |
| 5,175,565 | * | 12/1992 | Ishinaga | 347/17 X |
| 5,225,849 | * | 7/1993 | Suzuki | 347/14 |

FOREIGN PATENT DOCUMENTS

| | | | | |
|---|---|---|---|---|
| 2843064 | | 4/1979 | (DE) | B41J/3/04 |
| 2943164 | | 5/1980 | (DE) | B41J/3/04 |
| 0250266 | | 12/1987 | (EP) | B41J/3/04 |
| 3717294 | | 12/1987 | (DE) | B41J/3/04 |
| 0317342 | | 5/1989 | (EP) | B41J/3/04 |
| 54-51837 | | 4/1979 | (JP) | B41J/3/04 |
| 77946 | * | 4/1987 | (JP) | B41J/3/04 |
| 62-113564 | * | 5/1987 | (JP) | B41J/3/04 |
| 2-771554 | | 4/1990 | (JP) . | |

* cited by examiner

*Primary Examiner*—Fred L. Braun
(74) *Attorney, Agent, or Firm*—Fitzpatrick, Cella, Harper & Scinto

(57) ABSTRACT

A liquid jet recording head for selectively discharging recording liquid as liquid droplets from a plurality of discharge ports arranged in the main scanning direction along a substrate toward a recording medium to form dots on the recording medium and thereby accomplish recording is provided with heating means for heating the recording liquid through the substrate, and temperature detecting means for detecting the temperature of the recording liquid. The heating means is energized on the basis of the detected temperature from the temperature detecting means to keep the temperature of the recording liquid at a predetermined temperature, whereby the ratio of the diameter of the dots to the diameter of the liquid droplets can be maintained at a predetermined value.

3 Claims, 5 Drawing Sheets

INK JET RECORDING METHOD EMPLOYING CONTROL OF INK TEMPERATURE

This application is a continuation of application Ser. No. 07/934,900 filed Aug. 26, 1992, now abandoned, which was a continuation of application Ser. No. 07/577,735 filed Sep. 5, 1990, now abandoned.

BACKGROUND OF THE INVENTION

1. Field of the Invention

This invention relates to a liquid jet recording head, and in particular to a liquid jet recording head in which the temperature of the recording liquid is controlled, whereby the concentration of recorded images can be adjusted relative to various kinds of plain paper.

2. Related Background Art

Liquid jet recording methods can accomplish high-speed recording in which noise produced during recording are negligible, and moreover have recently been drawing attention in that they can accomplish recording without requiring any special processing such as fixation on so-called plain paper.

Among such methods, the liquid jet recording method described, for example, in Japanese Laid-Open Patent Application No. 54-51837 or German Laid-Open Patent Application (DOLS) No. 2843064 has features differing from those of the other liquid jet recording methods in that heat energy is caused to act on liquid to obtain a driving force for discharging liquid droplets.

That is, this liquid jet recording method is such that liquid subjected to the action of heat energy undergoes a state change accompanied by a steep increase in volume and the recording liquid is discharged from a discharge port at the fore end of a recording head unit by an action force based on the state change, whereby flying droplets are formed and adhere as dots to a recording medium to thereby accomplish recording. The the liquid jet recording method disclosed in DOLS No. 2843064 has the feature that not only it is very effectively applied to the so-called drop-on demand recording method, but also it can easily embody a recording head of the full line type having multiple orifices at a high density and therefore can provide images of high resolution and high quality at a high speed.

FIG. 7 of the accompanying drawings shows an example of the liquid jet recording head according to the prior art. In FIG. 7, the reference numeral 1 designates the substrate portion of the recording head, the reference numeral 2 denotes liquid paths formed in parallel on the substrate portion 1, the reference numeral 3 designates a common liquid chamber connected to the liquid paths 2, and the reference numeral 4 denotes heat-acting portions disposed in the liquid paths 2. Electro-thermal converting members as heat energy generating means for causing recording liquid to the discharged as flying liquid droplets from discharge ports 5 are provided in the heat-acting portions 4. Each electro-thermal converting member has a pair of electrodes and a heat generating resistance layer connected to these electrodes for generating heat, although they are not shown. The reference numeral 6 designates an upper lid member, and the reference numeral 7 denotes a recording liquid supply port formed in the upper lid member 6 over the common liquid chamber 3. Recording liquid is supplied from an outside recording liquid tank to the common liquid chamber 3 by a tube or the like through the supply port 7.

In such a liquid jet recording head, the recording liquid directed from the common liquid chamber 3 to the liquid paths 2 is heated and vaporized by the electro-thermal converting members in the heat-acting portions 4 being electrically energized, and a variation in the pressure thereof causes the recording liquid to be discharged as liquid droplets from the discharge ports 5 and shot onto a recording medium to form dots, and an image is recorded by an aggregate of these dots.

However, the prior-art liquid jet recording head as described above has suffered from the drawback that the diameter of liquid droplets discharged is fixed due to the limitations or the like in the manufacture of the head while, on the other hand, the rate of blur (the diameter of dots/the diameter of discharged liquid droplets) differs depending on the kinds of recording medium and accordingly, the recording concentration becomes diverse depending on the kinds of recording medium, but nevertheless, in the formation of discharged liquid droplets, no special consideration has been given to the speed thereof and the temperature of the recording liquid.

SUMMARY OF THE INVENTION

It is the object of the present invention to solve the above-noted problems peculiar to the prior art and to provide a recording head which can realize a desired recording concentration in conformity with the kinds of a recording medium and recording liquid.

To achieve such an object, the present invention provides a liquid jet recording head for selectively discharging recording liquid as liquid droplets from a plurality of discharge ports arranged in the main scanning direction along a substrate toward a recording medium to form dots on the recording medium and thereby accomplish recording, characterized in that provision is made of heating means for heating the recording liquid through the substrate, and temperature detecting means for detecting the temperature of the recording liquid, and said heating means is energized on the basis of the detected temperature from said temperature detecting means to keep the temperature of the recording liquid at a predetermined temperature, whereby the ratio of the diameter of said dots to the diameter of the liquid droplets can be maintained at a predetermined value.

According to the present invention, what rate of blur (the diameter of dots/the diameter of liquid droplets) can be obtained if at what degree the temperature of the recording liquid is kept can be known from the quality of the recording medium, the composition of the recording liquid and the arrangement density of the discharge ports in the recording head and therefore, by keeping such a temperature of the recording liquid that enables such a rate of blur to be obtained, an appropriate recording concentration can always be kept.

DESCRIPTION OF THE PREFERRED EMBODIMENTS

Some embodiments of the present invention will hereinafter be described in detail and specifically with reference to the drawings.

Figure 1:
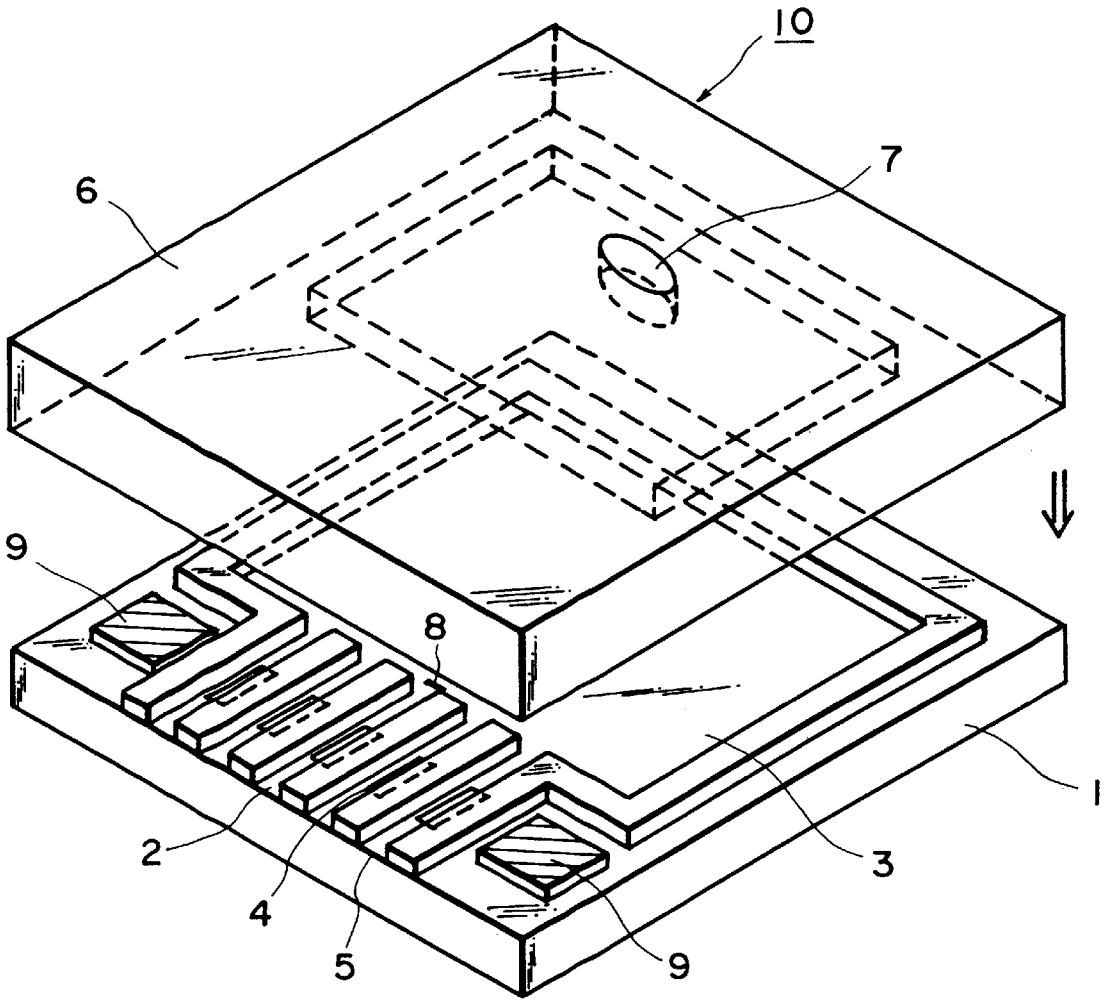
FIG. 1 is a perspective view showing an example of the construction of the liquid jet recording head of the present invention.

FIG. 1 shows an embodiment of the present invention. In this embodiment, temperature detecting means 8 is provided toward a liquid path 2 near the center of a common liquid chamber 3 on a substrate portion 1. In the present embodiment, a thermistor of good accuracy having a tolerance of the order of ±1° C. is used as the temperature detecting means 8, but inexpensive means such as a thermocouple can also be used if recording density is not strictly controlled.

The reference numeral 9 designates heaters as substrate heating means provided on both sides of a row of liquid paths on the substrate portion 1, and design is made such that recording liquid does not directly contact these heaters 9. The heaters 9 may be ones capable of increasing the temperature of the substrate to about 60° C. at highest in accordance with the temperature of the recording liquid, and these heaters 9 may be formed by a thin film forming technique at the same time the heat generating resistance members are formed on heat-acting portions 4. A Si substrate is used for the substrate portion 1 so that heat from the heaters 9 may be readily transmitted to the recording liquid.

Figure 2:
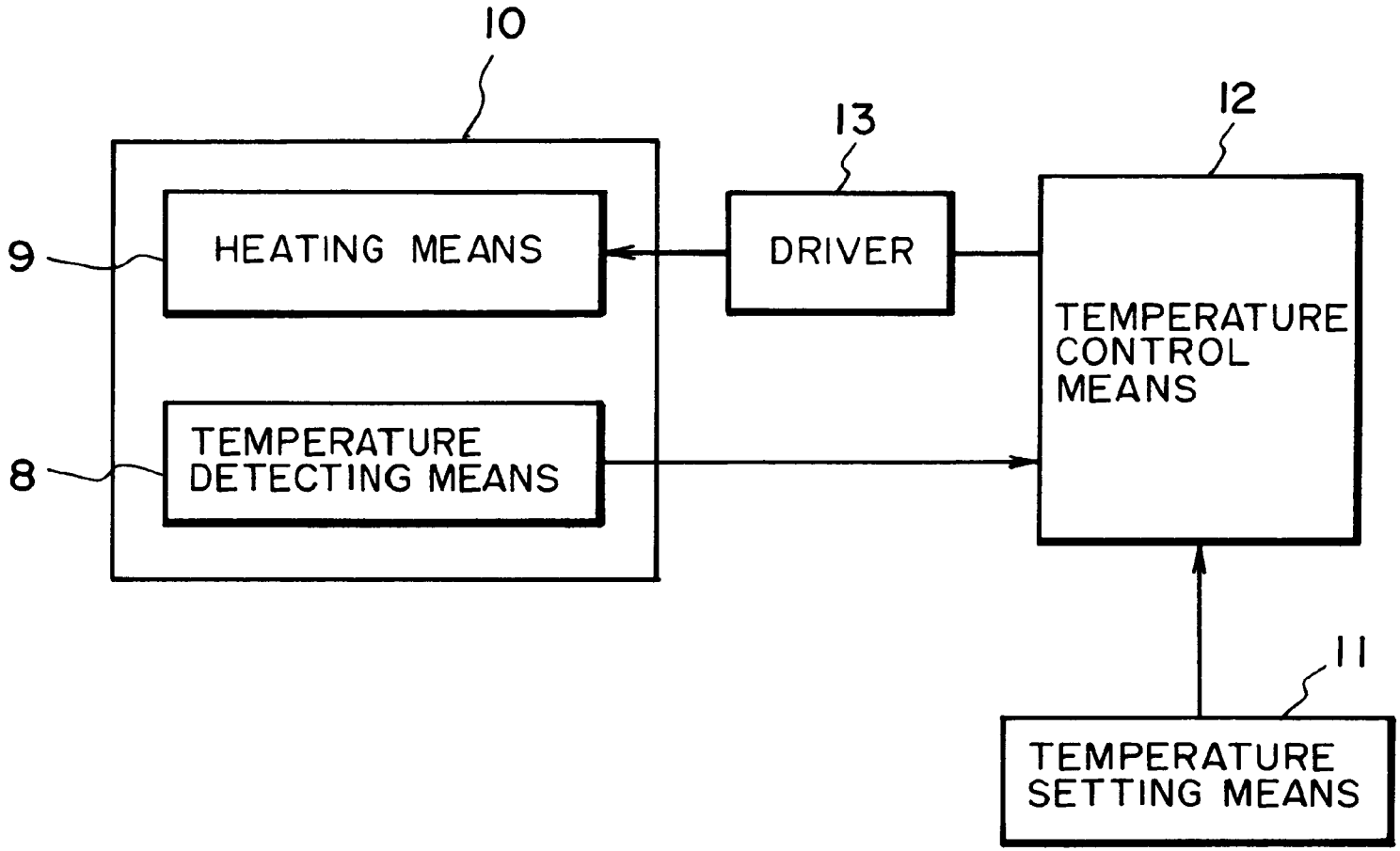
FIG. 2 is a block diagram showing a circuit construction for the recording liquid temperature control according to the present invention.

FIG. 2 diagrammatically shows a circuit construction for controlling the temperature of the recording liquid in the recording head 10 shown in FIG. 1. In FIG. 2, the reference numeral 11 denotes temperature setting means capable of arbitrarily selecting and indicating the temperature of the recording liquid, and the reference numeral 12 designates temperature control means for comparing the detected temperature from the temperature detecting means 8 with the temperature input from the temperature setting means 11 and energizing the heating means 9 through a driver 13 so that the former temperature may be the set temperature.

So, if the kind of recording medium, the composition of the recording liquid, the pitch of discharge ports 5 in the recording head and the diameter of discharged liquid droplets are known, a recording liquid temperature at which there is provided the diameter of dots for keeping an appropriate recording concentration correspondingly thereto can be indicated through the temperature setting means. Thereafter, in accordance with that indicated temperature, the temperature of the recording liquid can be controlled by the temperature control means 12 so as to be kept at the temperature.

Some specific embodiments will hereinafter be described.

First Embodiment

In the present embodiment, use was made of a recording head having a recording density of 300 dpi, i.e., provided with 64 liquid paths 2 at a pitch of 84.7 μm and capable of providing discharged liquid droplets of a diameter 50 μm, and recording liquid of the following composition was used:

| | |
|---|---|
| Carbon black | 3% |
| Diethylene glycol | 30% |
| Water | 67% |

Figure 3:
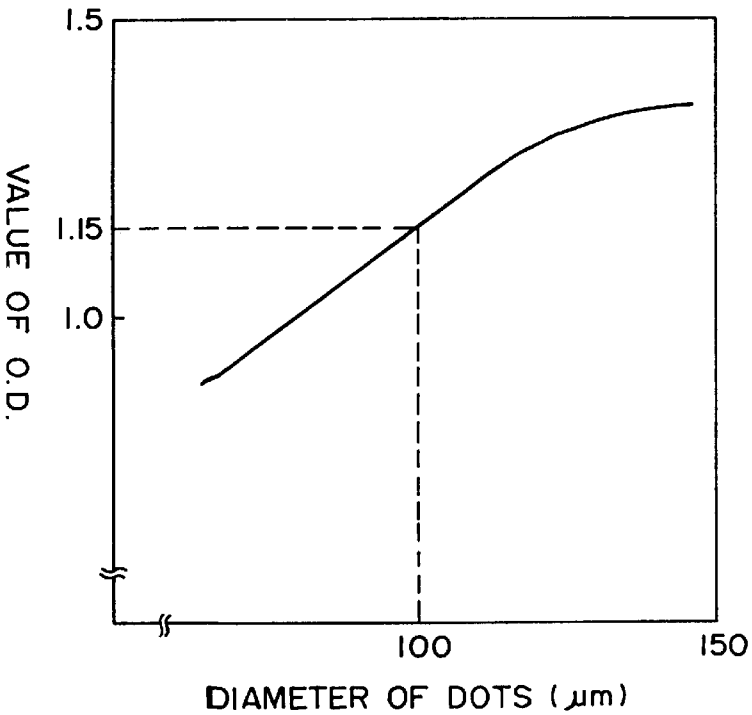
FIG. 3 is a graph showing the relation between the diameter of dots according to a first embodiment of the present invention and the value of O.D.

In the case of the present embodiment, the dot pitch is 84.7 μm and thus, if the diameter of dots is equal to or greater than the dot pitch, proper recording will be accomplished in principle. On the other hand, the recording concentration varies in accordance with the diameter of dots as shown in FIG. 3, but in the case of the present embodiment, the value of O.D. can be kept at 1.15 if the diameter of dots is 100 μm. In this case, the diameter of discharged liquid droplets is 50 μm and therefore, the rate of blur is 2.0.

Figure 4:
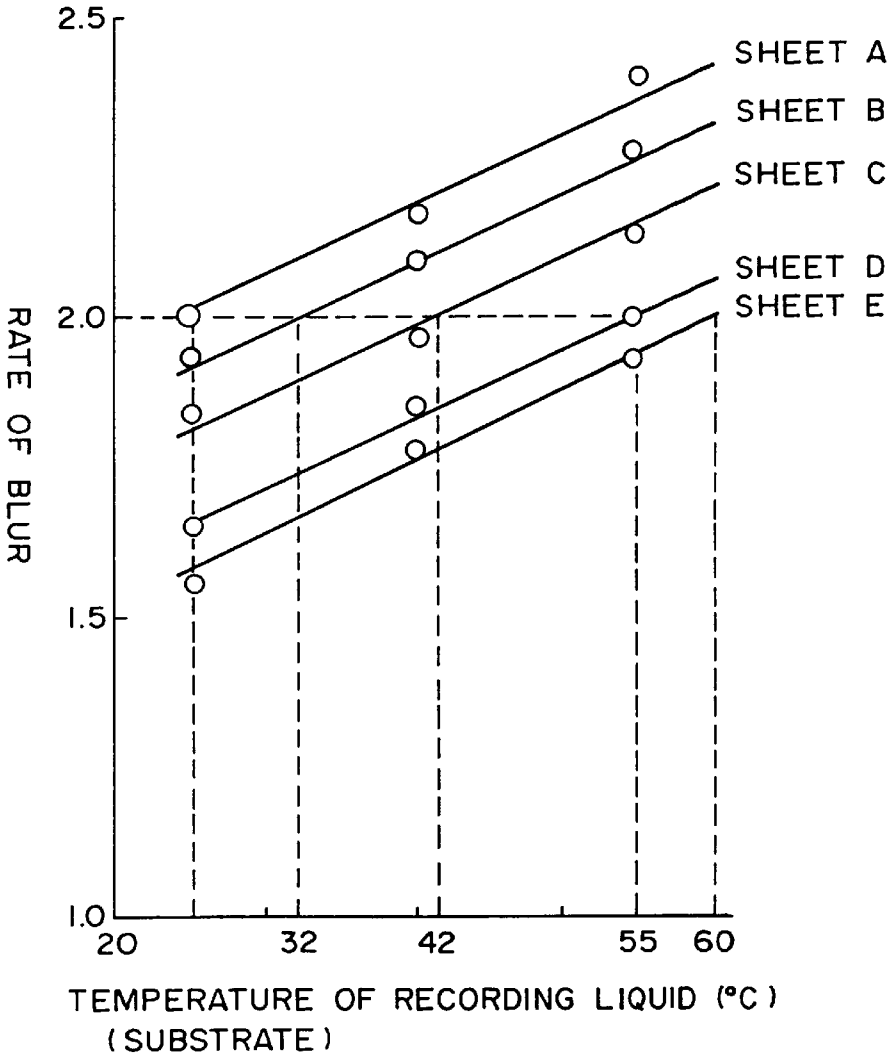
FIG. 4 is a graph showing the relation between the temperature of recording liquid according to the first embodiment of the present invention and the rate of blur.

So, in the present embodiment, when the relation between the temperature of the recording liquid (the temperature detected by the temperature detecting means 8) and the rate of blur was examined by the use of five kinds of plain paper A–E differing in paper quality, the rate of blur at a temperature of 25° C. when not heated was as follows as shown in FIG. 4:

Paper A . . . 2.00
Paper B . . . 1.93
Paper C . . . 1.83
Paper D . . . 1.65
Paper E . . . 1.56

Also, the following numerical values were obtained as the temperature of the recording liquid when in the five kinds of plain paper A–E, the rate of blur thereof was 2.0 to keep a predetermined appropriate recording concentration:

Paper A . . . 25° C.
Paper B . . . 32° C.
Paper C . . . 42° C.
Paper D . . . 55° C.
Paper E . . . 60° C.

Second Embodiment

In this embodiment, use was made of recording head having a recording density of 400 dpi,.i.e., provided with 256 liquid paths 2 at a pitch of 63.5 μm and capable of providing discharged liquid droplets of a diameter 40 μm, and as the heating means in this case, a large heater was brought into intimate contact with the back side of the substrate portion 1. This is because in the case of the present embodiment, the substrate becomes larger than in the first embodiment and a temperature gradient is liable to occur between the liquid path in the central portion and the liquid paths in the opposite end portions. The range of the controlled temperature for heating the substrate portion 1 was 25° C.–60° C.

Figure 5:
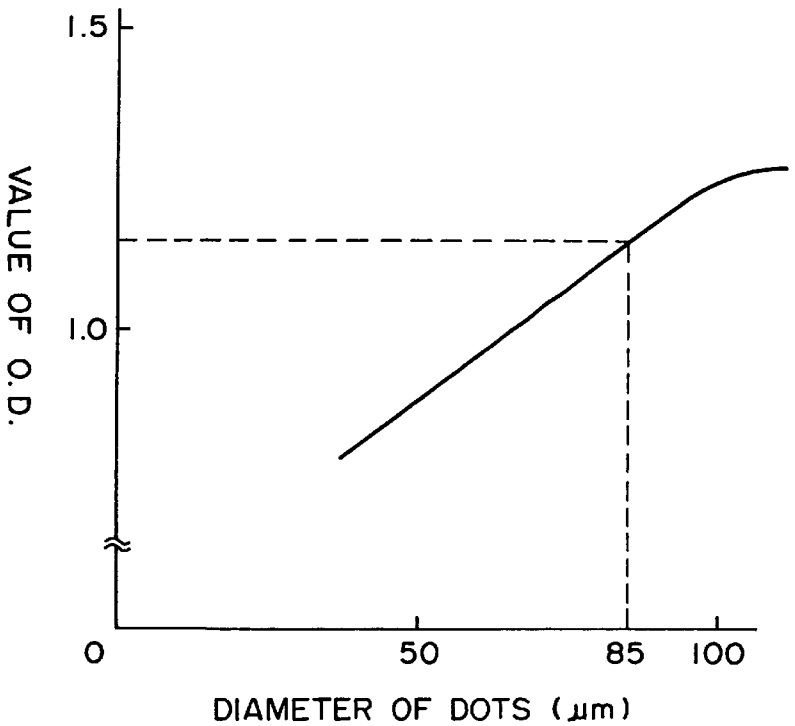
FIG. 5 is a graph showing the relation between the diameter of dots according to a second embodiment of the present invention and the value of O.D.
Figure 7:
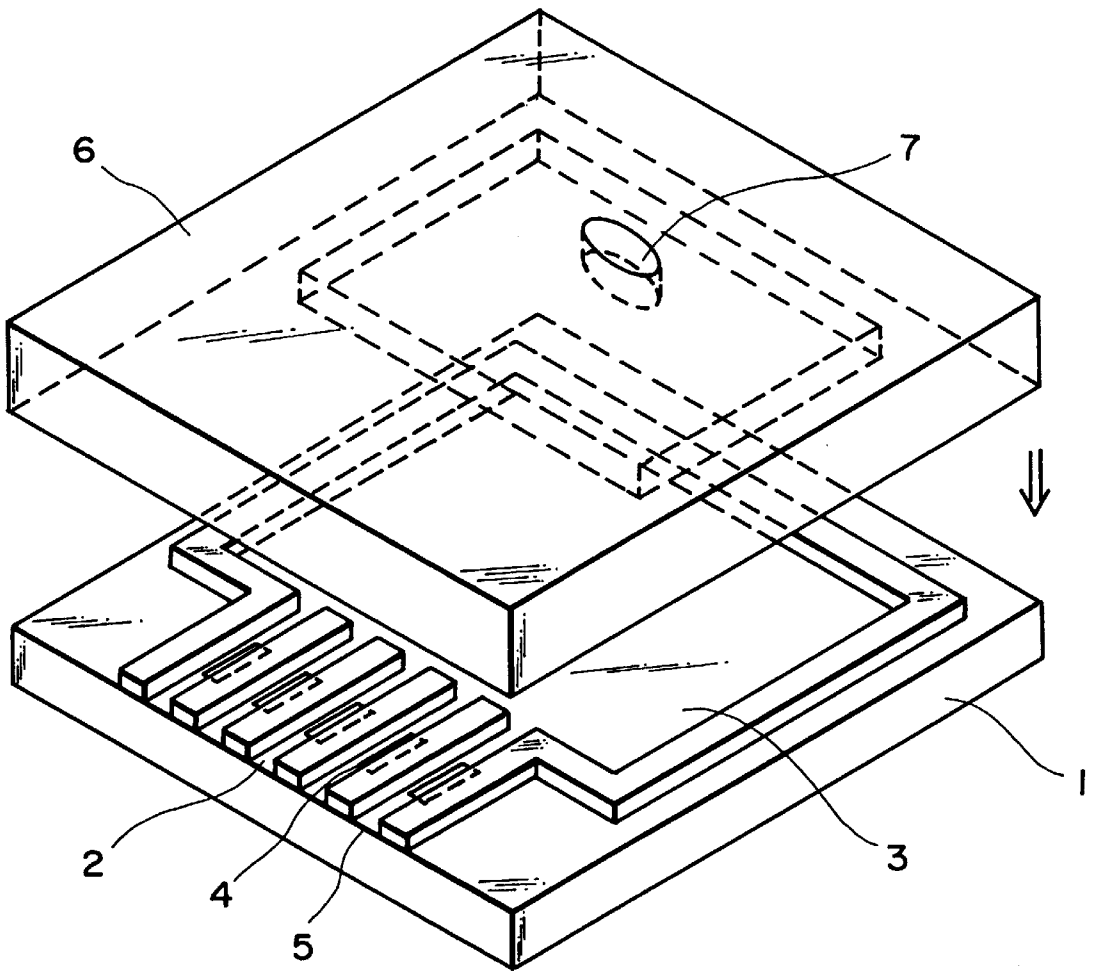
FIG. 7 PRIOR ART
FIG. 7 is a perspective view showing an example of the construction of the liquid jet recording head according to the prior art.

In the case of the present embodiment, the relation between the recording concentration and the diameter of dots is such as shown in FIG. 5 and therefore, to keep the value of O.D. at 1.15, it is necessary that the diameter of dots be 85 μm. Thus, in the case of the present embodiment, the diameter of discharged liquid droplets is 40 μm and therefore, it is seen that it is necessary that the rate of blur be 85/40=2.13 or more.

Figure 6:
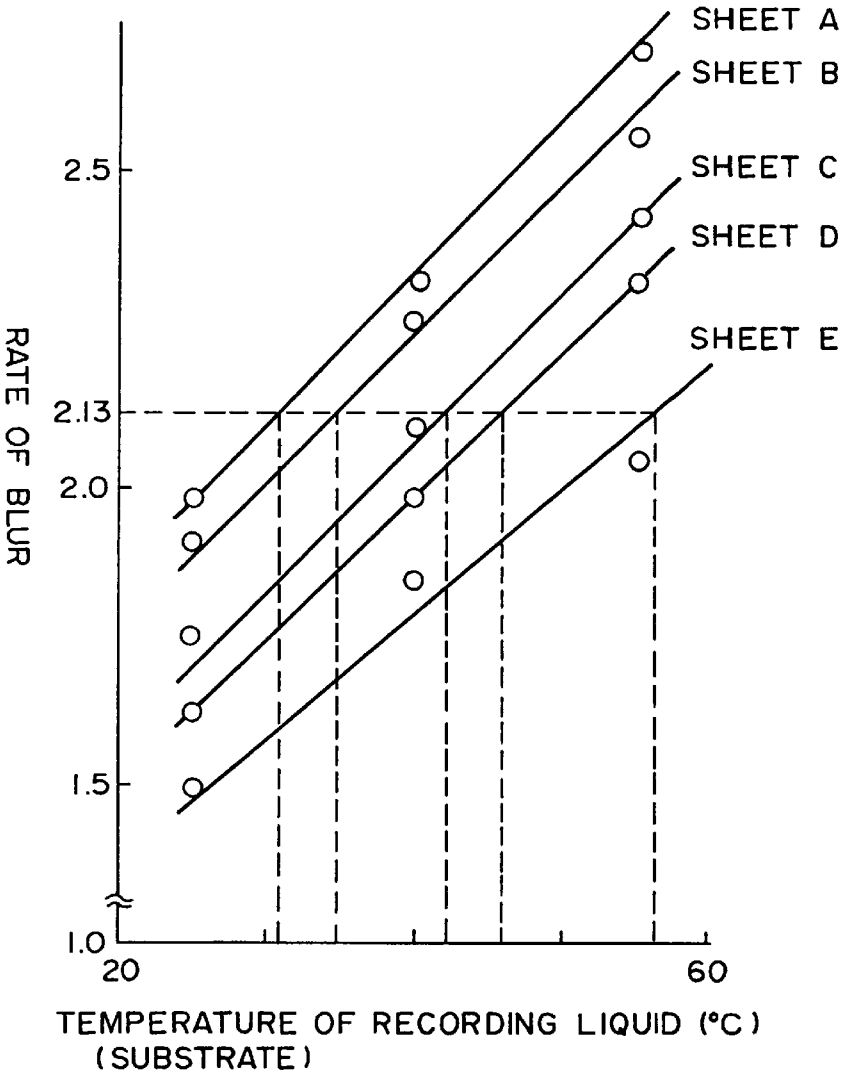
FIG. 6 is a graph showing the relation between the temperature of recording liquid according to the second embodiment of the present invention and the rate of blur.

In FIG. 6, there is shown the relation between the temperature of the recording liquid and the rate of blur in the present embodiment when use was made of five kinds of plain paper A–E differing in paper quality. In the present embodiment, recording liquid of the following composition was used.

| | |
|---|---|
| Carbon black | 5% |
| Diethylene glycol | 50% |
| Water | 45% |

In the case of the present embodiment, it is because recording liquid of a high solvent composition as shown above was used that the rate of increase in the rate of blur is high relation to the temperature of the recording liquid.

In the case of the present embodiment, the rates of blur of the five kinds of paper A–E at 25° C. were as follows:

Paper A . . . 1.98

Paper B . . . 1.91

Paper C . . . 1.75

Paper D . . . 1.62

Paper E . . . 1.49

Also, the temperature of the recording liquid for keeping the rate of blur at 2.13 was as follows for the five kinds of paper A–E:

Paper A . . . 31° C.

Paper B . . . 35° C.

Paper C . . . 42° C.

Paper D . . . 46° C.

Paper E . . . 56° C.

In the foregoing, description has been made of only two embodiments which differ in the structure of the recording head, the recording density and the recording liquid, whereas of course, the present invention is not restricted thereto, but is also applicable to various combinations of a recording head and recording liquid used.

As has hitherto been described, according to the present invention, provision is made of heating means for heating the recording liquid through a substrate, and temperature detecting means for detecting the temperature of the recording liquid before discharged, and the heating means is energized on the basis of the detected temperature from the temperature detecting means to keep the temperature of the recording liquid at a predetermined temperature, whereby the ratio of the diameter of dots to the diameter of liquid droplets can be maintained at a predetermined value and therefore, the maintenance of an appropriate recording concentration has become possible in conformity with the recording medium, the recording liquid and the recording density.

What is claimed is:

1. A method of printing on a recording medium of a first kind from among a plurality of different kinds of recording media, using a liquid jet recording head for discharging a recording liquid as a plurality of liquid droplets from a plurality of discharge ports arranged toward the recording medium to form a plurality of dots on the recording medium and thereby accomplish recording, the recording head comprising a heating unit arranged to heat the recording liquid through a substrate and a temperature detector arranged to detect a temperature of the recording liquid, said method comprising the steps of:

providing the recording liquid;

providing the recording medium;

determining a predetermined temperature at which a dot can be formed at a predetermined rate of blur, with respect to each of said plurality of kinds of recording media;

energizing the heating unit based on a detected temperature from the temperature detector to keep the temperature of the recording liquid at the predetermined temperature for the first kind of recording medium; and controlling the temperature of the recording liquid in the head so that the temperature of the recording liquid has a value determined in accordance with a rate of blur of the first kind of recording medium and a composition of the recording liquid so that when recording is performed, the dots recorded on the recording medium will have a desired value of diameter regardless of the kind of recording medium used.

2. A method according to claim 1, wherein the temperature of the ink is controlled to stay within a range of 25 to 60° C.

3. A method of printing on a recording medium of a first kind from among a plurality of different kinds of recording media, using a liquid jet recording head for discharging a recording liquid as a plurality of liquid droplets from a plurality of discharge ports arranged toward the recording medium to form a plurality of dots on said recording medium and thereby accomplish recording, the recording head comprising a heating unit arranged to heat the recording liquid through a substrate and a temperature detector arranged to detect a temperature of the recording liquid, said method comprising the steps of;

providing the recording liquid;

providing the recording medium;

determining a predetermined temperature at which a dot can be formed at a predetermined rate of blur, with respect to each kind of said plurality of kinds of recording media;

energizing the heating unit based on a detected temperature from the temperature detector to keep the temperature of the recording liquid at the predetermined temperature for the first kind of recording medium; and adjusting the temperature of the recording liquid according to the kind of recording medium upon which recording is being performed so that a rate of blur, which is defined by a diameter of the dots divided by a diameter of the discharged liquid droplets, has a predetermined value regardless of the kind of recording medium used.

* * * * *

UNITED STATES PATENT AND TRADEMARK OFFICE

CERTIFICATE OF CORRECTION

PATENT NO. : 6,231,152 B1
DATED : May 15, 2001
INVENTOR(S) : Koichi Sato et al.

It is certified that error appears in the above-identified patent and that said Letters Patent is hereby corrected as shown below:

Column 1,
Line 18, "are" should read -- is --; and
Line 37, "The the" should read -- The --.

Column 5,
Line 12, "high" should read -- high in --; and
Line 40, "discharged," should read -- discharge, --.

Signed and Sealed this

Second Day of April, 2002

*Attest:*

*Attesting Officer*

JAMES E. ROGAN
*Director of the United States Patent and Trademark Office*